US006230460B1

(12) United States Patent
Huyett

(10) Patent No.: US 6,230,460 B1
(45) Date of Patent: May 15, 2001

(54) RESILIENT FLOORING SYSTEM

(76) Inventor: Wesley Howard Huyett, 4111 Byrd Ct., Kensington, MD (US) 20895

( * ) Notice: Subject to any disclaimer, the term of this patent is extended or adjusted under 35 U.S.C. 154(b) by 0 days.

(21) Appl. No.: 09/532,830

(22) Filed: Mar. 21, 2000

(51) Int. Cl.[7] ..... E04F 15/22; E04B 5/43
(52) U.S. Cl. ..... 52/403.1; 52/480; 248/560
(58) Field of Search ..... 52/403.1, 480, 52/731.1; 472/92; 248/560

(56) References Cited

U.S. PATENT DOCUMENTS

| | | | | |
|---|---|---|---|---|
| 498,344 | | 5/1893 | Williams . | |
| 951,028 | * | 3/1910 | Schar . | |
| 2,014,643 | * | 9/1935 | Bakker . | |
| 2,862,255 | * | 12/1958 | Nelson . | |
| 4,879,857 | | 11/1989 | Peterson et al. . | |
| 5,277,010 | | 1/1994 | Stephenson et al. . | |
| 5,365,710 | | 11/1994 | Randjelovic . | |
| 5,682,724 | | 11/1997 | Randjelovic . | |
| 5,778,621 | * | 7/1998 | Randjelovic | 52/403.1 |
| 6,052,955 | * | 4/2000 | Haider | 52/167.5 |

FOREIGN PATENT DOCUMENTS

| | | | | |
|---|---|---|---|---|
| 1266291 | * | 5/1961 | (FR) | 52/403.1 |
| 456772 | | 11/1936 | (GB) . | |
| 466476 | * | 5/1961 | (GB) | 52/480 |
| 1201226 | | 8/1970 | (GB) . | |

* cited by examiner

*Primary Examiner*—Robert Canfield
(74) *Attorney, Agent, or Firm*—Stephen R. Greiner

(57) ABSTRACT

A resilient flooring system including a number of laterally spaced, shock absorbers for positioning upon a fixed subfloor. Each shock absorber includes a sole plate and a top plate retained in a spaced-apart relationship by a number of rubber spheres. The sole plate and the top plate have vertically aligned and cup-shaped sockets therein for retaining the spheres. A vertically movable decking is positioned atop the shock absorbers.

8 Claims, 1 Drawing Sheet

RESILIENT FLOORING SYSTEM

FIELD OF THE INVENTION

The present invention relates generally to static structures and, more particularly, to floor systems with underlying, compressible layers or pads.

BACKGROUND OF THE INVENTION

Professional dance companies, to improve the performances of their members and prolong their careers, have long used resilient flooring systems that "give" somewhat underfoot. Such systems typically include a wooden decking supported above an immovable base by compressible, rubber sheets or blocks. Although easy and inexpensive to install, conventional, resilient flooring systems are difficult to level and are prone to develop hard and soft spots which can destroy a dancer's rhythm and lead to fatigue or injury.

Resilient flooring systems designed to overcome these problems have been proposed. Unfortunately, they have not seen great commercial success since the supposed improvements add greatly to their cost and difficulties in installation. A need, therefore, exists for a flooring system that evenly deflects in response to a downward force and, then, rapidly rebounds to its original position yet is also uncomplicated in construction, easy to install and level, and low in cost.

SUMMARY OF THE INVENTION

In light of the problems associated with the known floor systems with underlying, compressible layers or pads, it is a principal object of the invention to provide a resilient flooring system with uniform, spring-like characteristics over the entirety of its surface and that is easy to install. The flooring system features a vertically movable decking supported by shock absorbers having a plurality of rubber spheres sandwiched between top and sole plates. A downward force applied to the decking is transmitted directly to the shock absorbers wherein the spheres are compressed in a manner that causes them to bulge at their centers and press against the top and sole plates. This deformation and pressure permits the decking to move slightly—first downwardly in a gradually decelerating manner and then upwardly in a rapid rebound to its original position.

It is another object of the invention to provide a resilient flooring system that can be accurately and easily leveled—the sole plate being easily shimmed to accomplish this end.

It is a further object of the invention to provide a resilient flooring system of uncomplicated construction that can be assembled with ease in an existing or new building from off-the-shelf parts without specialized tools or prolonged training. These parts can be inexpensively stored or, later, transported to the site of their assembly as a compact kit in a fully disassembled or partially disassembled state. If desired, the assembled flooring system can be easily broken down into its component parts, moved, and reassembled at a new site.

It is another object of the present invention to provide a resilient flooring system of the type described that absorbs sounds and mechanical vibrations. Such a flooring system is believed to be beneficial in: computer labs, hospital operating rooms, gymnasiums, dance halls, as well as television and sound recording studios among other locations.

It is an object of the invention to provide improved elements and arrangements thereof in an resilient flooring system for the purposes described which is lightweight in construction, inexpensive to manufacture, and fully dependable in use.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
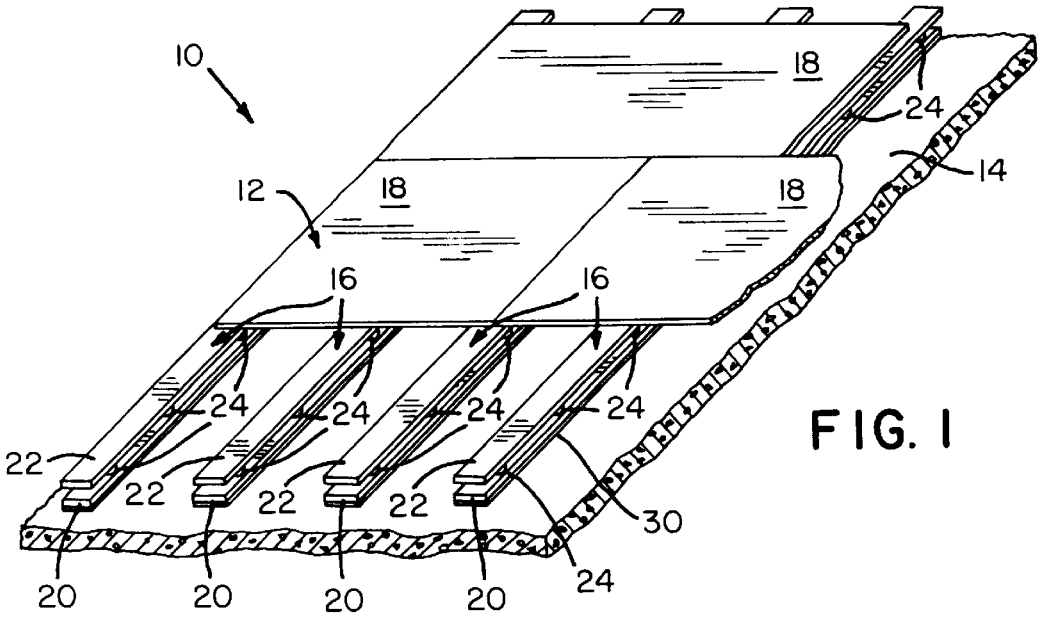
FIG. 1 is a perspective view of a portion of a resilient flooring system in accordance with the present invention.

Referring now to the FIGS., a resilient flooring system in accordance with the present invention is shown at 10. Flooring system 10 includes a vertically movable decking 12 supported above a fixed subfloor 14 by a plurality of laterally spaced, shock absorbers 16. In use, downward forces applied to decking 12 are imparted to shock absorbers 16 which compress evenly while taking up the forces and, then, rebound rapidly to their original positions in the manner of a spring.

Decking 12 comprises a plurality of plywood sheets 18 typically measuring 8 feet (2.4 m) in length by 4 feet (1.2 m) in width by ¾ inch (1.9 cm) in thickness. Sheets 18 are staggered at their joints which are preferably butt-type to ease construction burdens but may be tongue and groove-type if a flooring system of greater strength and durability is required. Although not shown in the FIGS., non-structural coverings, like resilient floor tiles, carpeting or padding, may be applied atop plywood sheets 18 to enhance both the appearance of decking 12 as well as user comfort.

Subfloor 14 is preferably a reinforced concrete slab. Such slabs are universally used in modern building construction and are known for their ability to transmit large loads to the ground. Other subfloor types such as: precast concrete planking, steel joist decking, and wood plank and beam, may be incorporated into the invention without adverse affect, however.

Each shock absorber 16 has a sole plate 20 and a top plate 22 retained in a spaced-apart relationship by a plurality of rubber spheres 24. Vertically aligned and cup-shaped sockets 26 and 28 respectively located in plates 20 and 22 retain spheres 24 within each shock absorber 16. Optionally, foam rubber strips 30 may be positioned beneath sole plates 20 to "fine tune" the shock absorbing qualities of flooring system 10.

Sole plate 20 and top plate 22 are preferably spruce or fir boards but could be formed from marine grade plywood, fiberglass or other suitable materials. Plates 20 and 22 are each about 8 feet (2.4 m) long, 4 inches (10 cm) wide and ¾ inches (1.9 cm) thick. Sockets 26 and 28 are about ⅝ inch to ¾ inch (1.6 cm to 1.9 cm) deep, are spaced about 16 inches to 24 inches (41 cm to 61 cm) apart, and have a radius of curvature that is the same as that of spheres 24, i.e., about 1¼ inches (3.2 cm) for a snug fit.

Spheres 24 are formed from neoprene, natural rubber or a like material. As shown, spheres 24 are solid and possess no internal cavities. Each has a durometer or hardness of about 40 or 50. Spheres 24 are preferably clamped within sockets 26 and 28 by the compressive action of plates 20 and 22 but, if desired, may be further secured within sockets by a suitable adhesive to permit shock absorbers 16 to be more easily transported and installed.

Beneath sole plates 20, strips 30 formed from foam rubber, neoprene, natural rubber or like material may be optionally positioned to enhance the performance of shock absorbers 16. Strips 30 are about 8 feet (2.4 m) long, 4 inches (10 cm) wide, and ¼ inch (0.64 cm) thick. Strips 30 not only permit the force absorbing qualities of shock absorbers 16 to be adjusted, but they serve as moisture barriers and the reduce noise caused by uneven sole plates 20 being driven into subfloor 14 during use.

Set up of resilient flooring system 10 is straightforward. First, a number of shock absorbers 16 are positioned upon a chosen portion of subfloor 14. It is preferred that shock absorbers 16 be laid end to end in continuous rows extending from one side of the area receiving resilient flooring system 10 to the other side thereof. Adjacent rows of shock absorbers 16 are set either 16 inches (41 cm) or 24 inches (61 cm) apart for ease in construction. Strips 30, if such are to be used, may be positioned beneath sole plates 20 at this time. Further, if subfloor 14 is not level, shims (not shown) may be inserted between sole plates 20 and subfloor 14 to bring all sole plates 20 into level alignment. Next, plywood sheets 18 are positioned atop shock absorbers 16 in an offset manner and are fastened to top plates 22 at spaced intervals by means of threaded fasteners 32. After positioning a nonstructural covering atop plywood sheets 18 the decking 12 and flooring system 10 is ready to use.

Figure 2:
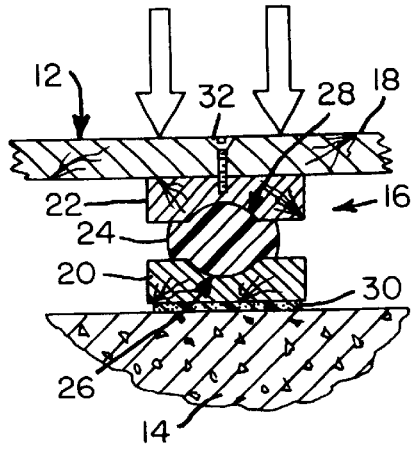
FIG. 2 is a cross-sectional view of a portion of the resilient flooring system of FIG. 1 under load.
Figure 3:
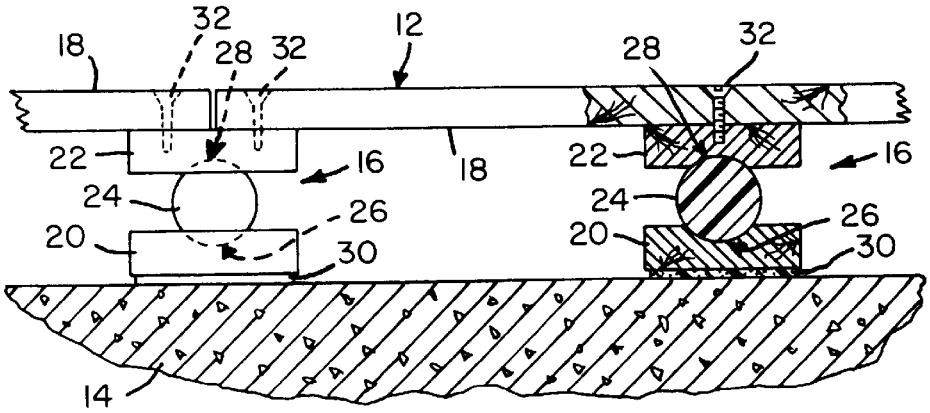
FIG. 3 is a side view of a portion of the resilient flooring system in an unloaded condition and with portions removed to show details thereof.

The resilient flooring system 10 is used in the manner of a conventional floor; however, shocks or blows will be dampened. Dampening occurs as spheres 24 are compressed between sole and top plates 20 and 22. When large forces are encountered, spheres 24 tend to bulge outwardly from retaining sockets 26 and 28 as shown in FIG. 2. Each outwardly bulging sphere 24 encroaches into the space between the sole and top plates 20 and 22 and presses against such plates in a geometric progression that tends to gradually decelerate the downwardly moving decking 12. Once the downward motion of decking 12 is halted, the resiliency of spheres 24 rapidly returns them to their original shape and returns decking 12 to its position before a downward force was imparted to it. One entire dampening cycle usually requires a fraction of a second to complete. Users are treated to a lifetime of comfort.

While the invention has been described with a high degree of particularity, it will be appreciated by those skilled in the art that modifications may be made thereto. For example, the number, location and dimensions of the elements of the shock absorbers 16 may be varied to control the resiliency of flooring system 10. Therefore, it is to be understood that the present invention is not limited to the sole embodiment described above, but encompasses any and all embodiments within the scope of the following claims.

I claim:

1. A resilient flooring system, comprising:

a plurality of laterally spaced, shock absorbers adapted for positioning upon a fixed subfloor, each shock absorber including an elongated sole plate and an elongated top plate retained in a spaced-apart relationship by a plurality of rubber spheres, said sole plate and said top plate having vertically aligned and cup-shaped sockets therein for retaining said spheres; and, a vertically movable decking positioned atop said shock absorbers.

2. The resilient flooring system according to claim 1 wherein each said shock absorber further includes a resilient strip positioned beneath said sole plate.

3. A resilient flooring system, comprising:

at least one shock including:

an elongated sole plate adapted for positioning upon a fixed subfloor, said sole plate having a plurality of first, spaced-apart and cup-shaped sockets in its top;

a plurality of rubber spheres each being respectively positioned in one of said first, spaced-apart and cup-shaped sockets in said sole plate;

an elongated top plate resting upon said rubber spheres, said top plate having a plurality of second, spaced-apart and cup shaped sockets in its bottom for receiving said rubber spheres; and, a vertically movable decking positioned atop said shock absorber.

4. The resilient flooring system according to claim 3 wherein said shock absorber further includes a resilient strip positioned beneath said sole plate.

5. The resilient flooring system according to claim 3 wherein said first sockets and said second sockets have a radius of curvature that is substantially the same as that of said spheres.

6. A shock absorber for a resilient flooring system, comprising:

an elongated sole plate adapted for positioning upon a fixed subfloor, said sole plate having a plurality of first, spaced-apart and cup-shaped sockets in its top;

a plurality of resilient spheres each being respectively positioned in one of said first, spaced-apart and cup-shaped sockets in said sole plate; and, an elongated top plate resting upon said resilient spheres, said top plate having a plurality of second, spaced-apart and cup shaped sockets in its bottom for receiving said resilient spheres.

7. The shock absorber according to claim 6 further comprising a resilient strip positioned beneath said sole plate.

8. The shock absorber according to claim 6 wherein said first sockets and said second sockets have a radius of curvature that is substantially the same as that of said spheres.

* * * * *